US006273797B1

(12) United States Patent
Becker et al.

(10) Patent No.: US 6,273,797 B1
(45) Date of Patent: Aug. 14, 2001

(54) IN-SITU AUTOMATED CMP WEDGE CONDITIONER

(75) Inventors: Kent R. Becker, Fairfax; Scott R. Cline, Enosburg Falls; Paul A. Manfredi, Waterbury Center; Douglas P. Nadeau, Underhill, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/444,285

(22) Filed: Nov. 19, 1999

(51) Int. Cl.[7] ..... B24B 1/00

(52) U.S. Cl. ..... 451/56; 451/288; 451/41; 451/60; 451/443; 451/446; 451/287

(58) Field of Search ..... 451/288, 41, 56, 451/60, 443, 444, 446, 285, 287

(56) References Cited

U.S. PATENT DOCUMENTS

| | | | | |
|---|---|---|---|---|
| 5,154,021 | | 10/1992 | Bombardier et al. . | |
| 5,558,111 | | 9/1996 | Lofaro . | |
| 5,578,529 | | 11/1996 | Mullins . | |
| 5,650,039 | * | 7/1997 | Talieh | 156/636.1 |
| 5,709,755 | | 1/1998 | Kuo et al. . | |
| 5,762,544 | * | 6/1998 | Zuniga et al. | 451/285 |
| 5,775,983 | | 7/1998 | Shendon et al. . | |
| 5,785,585 | * | 7/1998 | Manfredi et al. | 451/288 |
| 6,126,517 | * | 10/2000 | Tolles et al. | 451/41 |

* cited by examiner

*Primary Examiner*—Joseph J. Hail, III
*Assistant Examiner*—Shantese McDonald
(74) *Attorney, Agent, or Firm*—Schmeiser, Olsen & Watts; Robert A. Walsh

(57) ABSTRACT

An apparatus and method of conditioning a CMP polishing pad to ensure consistent polishing throughout the polishing process. In particular, the apparatus consists of a translatable wedge-shaped conditioning plate, having a three point adjustable contact to ensure proper alignment with the polishing pad; a high pressure conditioning spray nozzle to clean the polishing pad and conditioning assembly throughout polishing; and a slurry dispensing nozzle to enhance planarization of the wafer. Further, the frequency of oscillation may be varied by the operator to prevent grooves from forming in the polishing pad.

13 Claims, 3 Drawing Sheets

IN-SITU AUTOMATED CMP WEDGE CONDITIONER

BACKGROUND OF THE INVENTION

1. Technical Field

The present invention relates generally to semiconductor processing and, more particularly, to chemical-mechanical polishing used to planarize a semiconductor substrate.

2. Related Art

Chemical-mechanical polishing (hereinafter "CMP"), is a common method of planarization used in semiconductor manufacture. CMP typically involves the use of a circular polishing pad, mounted to a polishing table or platen, which is transported and held in contact with the surface of the semiconductor wafer via a carrier. An abrasive slurry, typically water-based, is applied to the surface of the polishing pad to facilitate and enhance polishing of the wafer. During polishing both polishing pad and wafer are rotated relative to one another. As a result, unwanted material is removed from the surface of the wafer, producing a planarized surface.

However, during polishing the surface of the polishing pad becomes matted and unevenly worn. This occurs for several reasons. For example, the pores in the surface of the pad which deliver slurry to the wafer become clogged with slurry and particulate material removed from the wafer. Further, the frictional polishing action designed to planarize the wafer also begins to planarize or wear the pad surface over time. Therefore, one key to effectively employing CMP methods is maintaining the consistency and integrity of the polishing pad surface throughout polishing. This necessitates conditioning the pad surface at frequent intervals to prevent degradation of the polishing pad surface.

Although typical devices used in the industry condition the polishing pad both before and after each wafer polishing cycle, non-uniformities occur within each cycle as a result of the wear discussed above. In addition, the majority of these conditioning techniques and devices are very time consuming, difficult to use and therefore, not cost effective.

In an attempt to remedy the defect, a prior art technique described in U.S. Pat. No. 5,785,585 to Manfredi et al., provides an in-situ conditioning method. Specifically, a stationary wedge-shaped conditioning plate, having a roughened bottom surface, rests flat on the polishing pad surface. Throughout polishing the pad is abraded by the wedge conditioner, thereby providing a consistent and reliable polish for the entirety of each wafer polishing cycle.

Although the method described in Manfredi et al. is quite effective when used with soft pads, such as suba-4, manufactured by Rodel Corporation, it is less effective when used with harder pads, such as IC-1000, by the same manufacturer. In particular, grooves often form in the pad surface, producing reservoirs in which the slurry collects, thereby preventing slurry from reaching the wafer surface. Further, particulate material removed from both the polishing pad and the wafer builds up at the edge of the conditioning plate, thereby interfering with effectiveness of the polishing.

Accordingly, there exists a need in the industry for a simpler, more cost effective apparatus for, and method of, maintaining a consistent polishing surface, for both hard and soft pads, by conditioning the pad throughout the polishing process.

SUMMARY OF THE INVENTION

The present invention provides an automated in-situ CMP pad conditioner for, and method of, cost effectively maintaining pad surface consistency throughout the duration of the polishing process, thereby producing consistent polishing over time.

A first general aspect of the present invention provides an apparatus for conditioning a polishing pad, comprising: a translatable plate positioned above the polishing pad; an elongated conduit having a plurality of outlets which deliver fluid to the polishing pad surface; and a translating means to move the translatable plate relative to the polishing pad. This aspect allows for the automatic conditioning of a polishing pad to ensure polishing pad consistency throughout the polishing process. Further, this aspect prevents the build-up of excess slurry and particulate material on the polishing pad surface, as well as at the edge of the conditioning plate.

A second general aspect of the present invention provides a method for conditioning a polishing pad surface throughout a polishing process, comprising the steps of: providing a translatable conditioning plate in contact with the polishing pad surface; oscillating the translatable conditioning plate relative to the rotating polishing pad surface; and dispensing a high pressure spray conditioning fluid over the polishing pad surface. This aspect provides for a method of maintaining polishing pad surface consistency throughout polishing, and provides similar advantages as those mentioned with respect to the first aspect.

A third general aspect of the present invention provides an apparatus for conditioning a polishing pad, comprising: a translatable conditioning plate positioned above the polishing pad; a translating means to move the translatable conditioning plate; and a fluid delivery mechanism affixed to the translatable conditioning plate. This aspect allows for similar advantages as those discussed with respect to the first aspect.

The foregoing and other features and advantages of the present invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiments.

Figure 1:
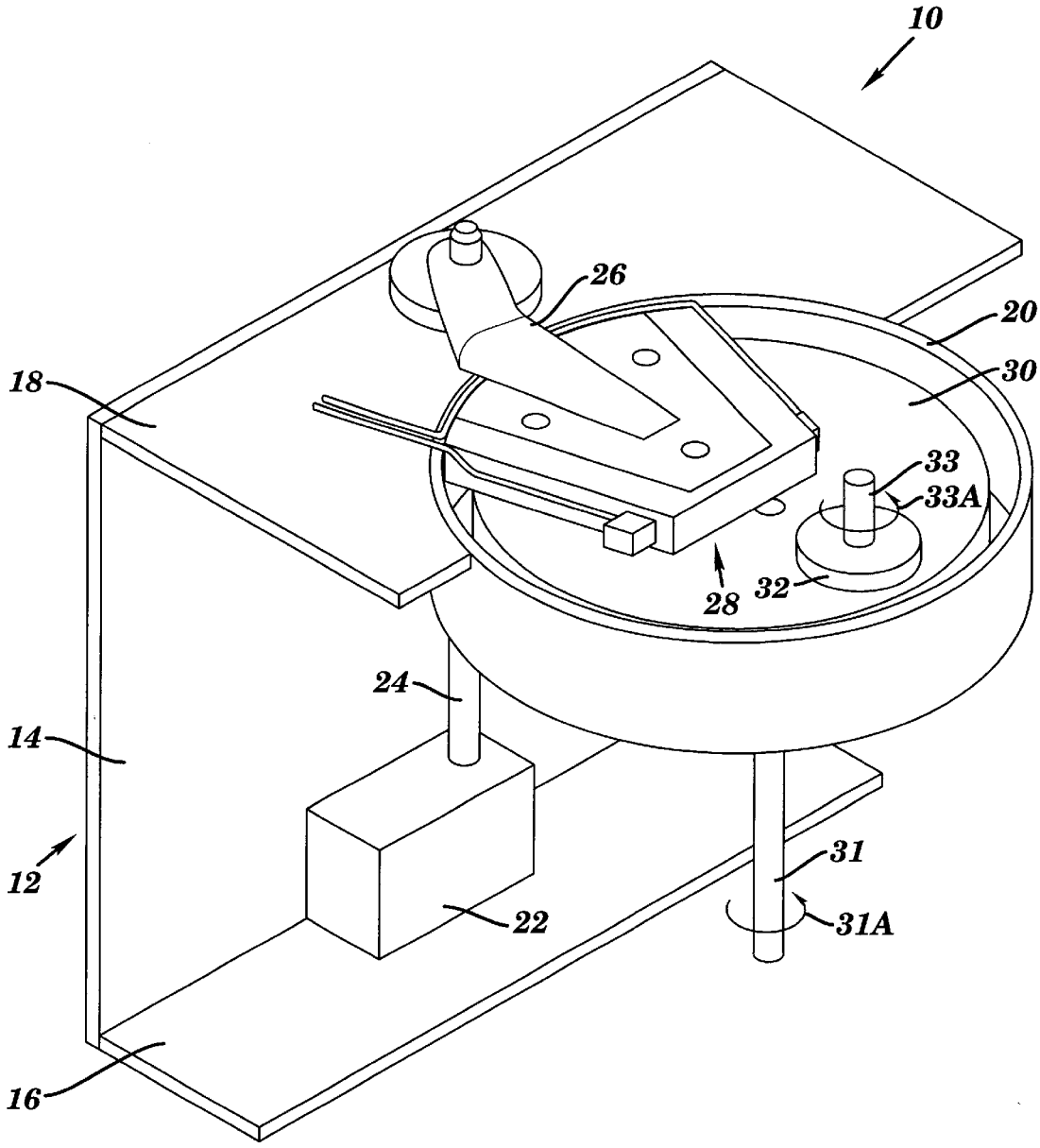
FIG. 1 depicts a CMP polishing unit in accordance with the present invention.

FIG. 1 depicts the components of CMP polishing unit 10 in accordance with the present invention. In particular, polishing unit 10 includes a frame 12, comprising a vertical back 14, a bottom 16, a top 18, and a circular retaining ring 20 affixed to and extending outwardly from top 18. A power unit 22, containing the typical necessary components, i.e., a motor, cam, etc. (individual components not shown) is mounted on bottom 16 of frame 12 to supply the requisite power to unit 10. Power unit 22 receives a vertical shaft 24, extending upwardly and protruding through top 18. Lifting mechanism 26 is mounted to the portion of vertical shaft 24 that protrudes through top 18. Vertical shaft 24 and lifting mechanism 26 work in conjunction to control movement of wedge conditioning assembly 28, which is mounted to the under side of lifting mechanism 26 via bolts, screws, etc. In particular, vertical shaft 24 provides conditioning assembly 28 with oscillatory movement, and lifting mechanism 26 provides wedge conditioning assembly 28 with vertical movement with respect to polishing pad 30. Wedge conditioning assembly 28 fits within and abuts circular retaining ring 20.

A polishing pad 30 is mounted on a circular platen or table (not shown), and positioned within circular retaining ring 20. Polishing pad 30 rotates about shaft 31 in the direction indicated by directional arrow 31A, at a speed between 0 and 100 rpm, and engages the underside of wedge conditioning assembly 28. At a location apart from wedge conditioning assembly 28 on polishing pad 30, a wafer carrier 32, rotating about shaft 33, typically in the same direction as polishing pad 30, illustrated by directional arrow 33A, at between 0 and 100 rpm, forcibly holds a wafer (located at the underside of carrier 32, but not shown) face down on polishing pad 30.

Figure 2:
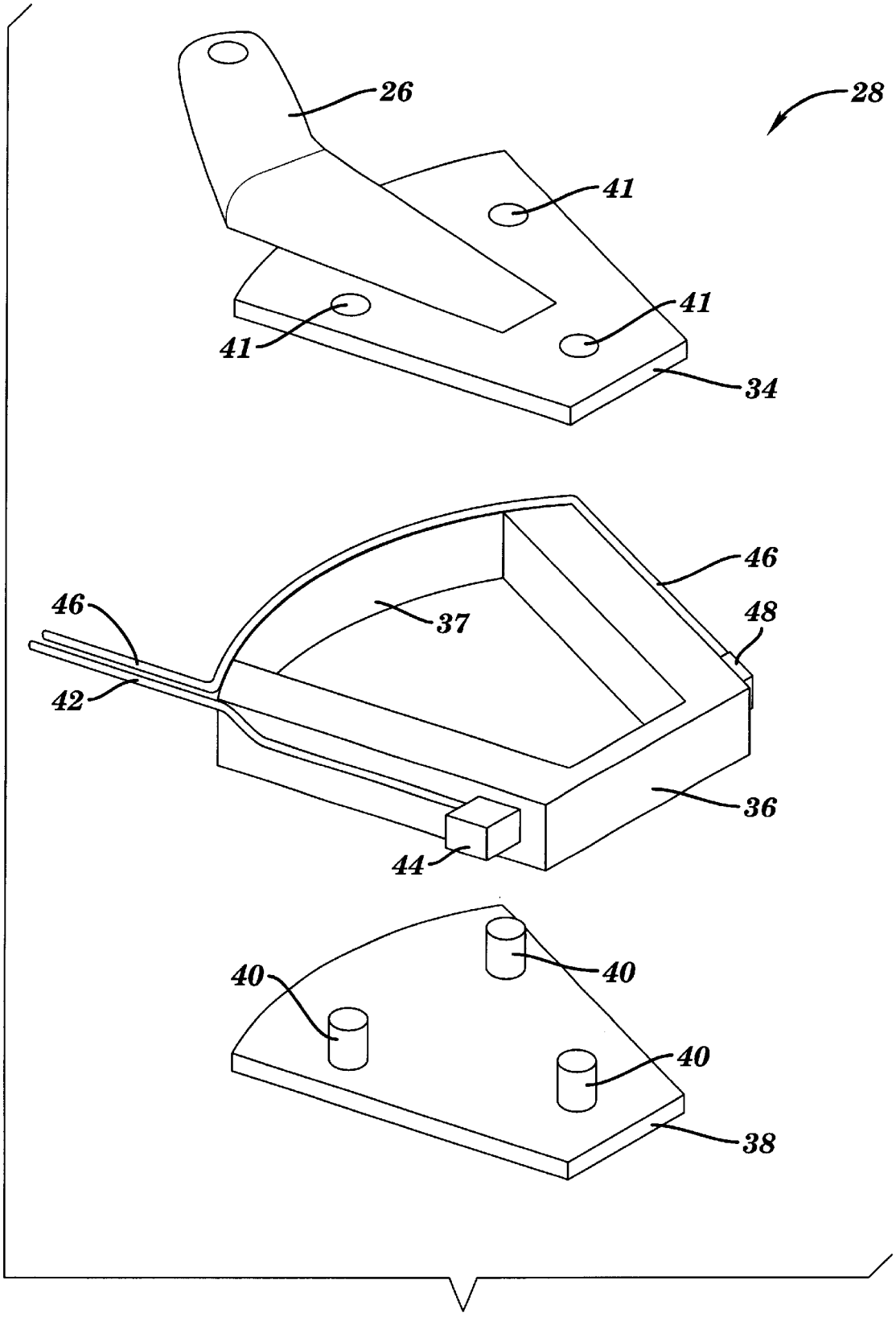
FIG. 2 depicts the three segments of the wedge conditioning assembly in accordance with the present invention.

As depicted in FIG. 2, wedge conditioning assembly 28 comprises three wedge-shaped segments, including an upper plate 34, a retaining frame 36, and a lower conditioning plate 38. Retaining frame 36 fits loosely around the outside of both upper plate 34 and lower conditioning plate 38, and functions to hold and guide upper plate 34 and lower conditioning plate 38. Pipe 42 is mounted along the side of retaining frame 36, ending in a nozzle 44. Pipe 42 contains two internal chambers (not shown), one containing an abrasive slurry, such as silica, etc., and the other containing pressurized air. Both slurry and pressurized air exit nozzle 44 simultaneously, thereby uniformly dispensing atomized slurry over the surface of polishing pad 30. This fine spray of slurry facilitates and enhances mechanical etching of the wafer. Similarly, pipe 46 is fastened along the back edge 37 and outside of retaining frame 36 ending in a high pressure nozzle 48, which dispenses conditioning solution onto polishing pad 30. The high pressure nozzle 48 is mounted on the up-stream side of wedge conditioning assembly 28. In other words, high pressure nozzle 48 dispenses conditioning fluid onto the surface of polishing pad 30 before polishing pad 30 contacts lower conditioning plate 38. This ensures that polishing pad 30 is cleaned of debris, such as excess slurry and particulate material, before conditioning to prevent build-up of excess slurry and particulate material at the edge of wedge conditioning assembly 28, as discussed with the prior art. Upper plate 34, held within retaining frame 36, is mounted to the under side of lifting mechanism 26, via bolts, or other conventional means. Lower conditioning plate 38, typically having the same dimensions as upper plate 34 and held within retaining frame 36, has cylindrical pins or posts 40 extending upwardly, which slidably engage holes 41 of upper plate 34. This "three point contact" allows lower conditioning plate 38 to move relative to upper plate 34, thereby ensuring wedge conditioning assembly 28 is in parallel with polishing pad 30.

Figure 3:
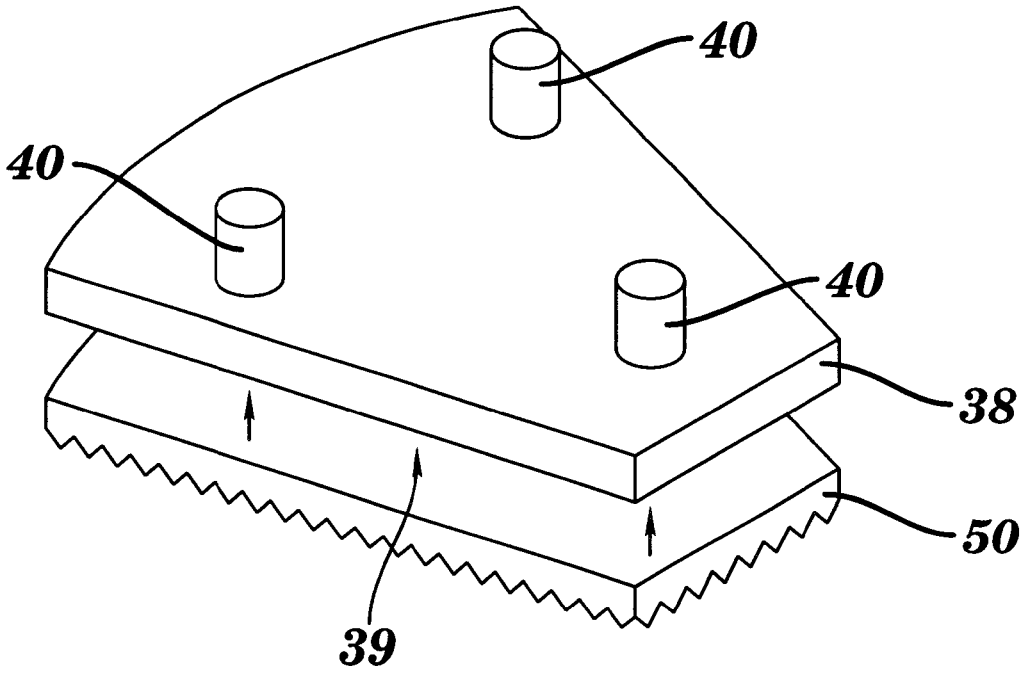
FIG. 3 depicts the lower conditioning plate of the wedge conditioning assembly in accordance with the present invention.

FIG. 3 shows lower conditioning plate 38, having a roughened sheet 50 mounted on the bottom face 39, via glueing or other means. Roughened sheet 50 contacts polishing pad 30, thereby abrading and conditioning the surface of polishing pad 30. Roughened sheet 50 may be made of a metal-bonded diamond grinding disc, i.e., nickel-bonded diamond, etc.

Directing attention again to FIG. 1 and the operation of CMP unit 10, rotation of polishing pad 30 about shaft 31 is maintained throughout the polishing process. Lifting mechanism 26 raises wedge conditioning assembly 28 off polishing pad 30, thereby allowing wafer carrier 32 to transport a wafer (not shown) to the surface of polishing pad 30. Lifting mechanism 26 then lowers wedge conditioning assembly 28 into contact with polishing pad 30. Since wedge conditioning assembly 28 contains the three point contact, thereby facilitating slidable adjustability, lower conditioning plate 38 (in FIG. 2) moves vertically with respect to upper plate 34, within retaining frame 36, and ensures parallel contact with polishing pad 30. This is important because tolerances vary between different polishing pads used in CMP polishing units, and a parallel contact is vital to uniform conditioning.

Once wedge conditioning assembly 28 is parallel with polishing pad 30, a pneumatic cylinder or air cushion system, applies a downward force on wedge conditioning assembly 28 to enhance the abrading effects of roughened sheet 50. Simultaneously, a force is applied to counteract the downward force, thereby allowing the operator to control the amount of force applied (from between 0 psi to full static weight) at any given time.

Slurry, such as silica, or other water-based slurry, is delivered to the surface of polishing pad 30 via pipe 42 and nozzle 44 (refer to FIG. 2) throughout the wafer polishing cycle to enhance planarization. Spray conditioner is also delivered to the surface of polishing pad 30 throughout the wafer polishing cycle, via pipe 46 and high pressure nozzle 48. The conditioner delivered by high pressure nozzle 48 forces the excess expended slurry and particulate material off the surface of polishing pad 30, effectively cleaning the polishing pad 30 before it contacts lower conditioning plate 38 (refer to FIG. 2). The conditioner supplied by high pressure nozzle 48 also forces any debris attached to the leading edge of wedge conditioning assembly 28 off polishing pad 30, which may interfere with conditioning.

Dictated by the cam profile (within power unit 22) which is selected by the operator, wedge conditioning assembly 28 oscillates, thereby abrading an arc within the surface of polishing pad 30. The arc produced is typically, but not limited to, a sin wave. The oscillatory motion prevents grooves from forming within the pad surface caused by the repeated abrading by roughened sheet 50 affixed to lower conditioning plate 38 (refer to FIG. 3). It is important to note that the cam profile may be altered by the operator, thereby changing the arc produced within the pad surface. In other words, by changing the cam profile, the frequency of oscillation of wedge conditioning assembly 28 may be varied, thereby altering the pad conditioning characteristics. It should be appreciated that the oscillation of wedge conditioning assembly is not restricted to movement in merely two directions.

When the polishing cycle is completed for a single wafer, lifting mechanism 26 raises wedge conditioning. assembly 28 off of polishing pad 30, thereby allowing carrier 32 to lift the wafer from the surface of polishing pad 30. Another wafer within carrier 32 may be placed on polishing surface 30 and the process repeated.

While this invention has been described in conjunction with the specific embodiments outlined above, it is evident that many alternatives, modifications and variations will be apparent to those skilled in the art. Accordingly, the preferred embodiments of the invention set forth above are intended to be illustrative, not limiting. Various changes may be made without departing from the spirit and scope of the invention as defined in the following claims.

We claim:

1. An apparatus for conditioning a polishing pad, comprising:

a translatable plate positioned above the polishing pad;

an elongated conduit, coupled to the translatable plate, having a plurality of outlets which deliver fluid to the polishing pad surface; and a translating system to move the translatable plate relative to the polishing pad.

2. The apparatus of claim 1, wherein the translatable plate includes an adjustable contact with the polishing pad, to ensure parallel alignment.

3. The apparatus of claim 1, further including a system to provide a downward force to the translatable plate.

4. The apparatus of claim 3, wherein the system is a pneumatic cylinder.

5. The apparatus of claim 1, wherein the elongated conduit delivers atomized slurry to the polishing pad surface.

6. The apparatus of claim l, wherein the elongated conduit delivers high pressure conditioning fluid to the polishing pad surface.

7. The apparatus of claim 1, wherein the motion of the translating system may be varied.

8. A method for conditioning a polishing pad surface throughout a polishing process, comprising the steps of:

providing a translatable conditioning plate in contact with the polishing pad surface;

oscillating the translatable conditioning plate relative to the rotating polishing pad surface;

coupling a system, for providing a high pressure spray conditioning fluid, to the translatable conditioning plate; and dispensing the high pressure spray conditioning fluid over the polishing pad surface.

9. The method of claim 8, wherein the translatable conditioning plate includes an adjustable contact to ensure parallel alignment with the polishing pad surface.

10. The method of claim 8, wherein a frequency of oscillation of the translatable conditioning plate over the polishing pad surface is adjustable.

11. An apparatus for conditioning a polishing pad, comprising:

a translatable conditioning plate positioned above the polishing pad;

a translating means to move the translatable conditioning plate; and a fluid delivery mechanism affixed to the translatable conditioning plate.

12. The apparatus of claim 11, wherein the fluid delivery mechanism consists of a slurry atomization unit and a high pressure spray conditioning unit.

13. The apparatus of claim 11, wherein the translating means causes conditioning plate to oscillate with respect to the polishing pad.

* * * * *